US007871495B2

(12) United States Patent
Savolainen

(10) Patent No.: US 7,871,495 B2
(45) Date of Patent: Jan. 18, 2011

(54) DEVICE FOR REMOVING LIQUID FROM A MOVING FABRIC OR WEB

(75) Inventor: Olavi Savolainen, Tampere (FI)

(73) Assignee: Effcom Oy, Tampere (FI)

( * ) Notice: Subject to any disclaimer, the term of this patent is extended or adjusted under 35 U.S.C. 154(b) by 693 days.

(21) Appl. No.: 11/885,058

(22) PCT Filed: Feb. 21, 2006

(86) PCT No.: PCT/FI2006/050074

§ 371 (c)(1),
(2), (4) Date: Aug. 24, 2007

(87) PCT Pub. No.: WO2006/090012

PCT Pub. Date: Aug. 31, 2006

(65) Prior Publication Data

US 2008/0142180 A1 Jun. 19, 2008

(30) Foreign Application Priority Data

Feb. 24, 2005 (FI) ..... 20055092

(51) Int. Cl.
*D21G 3/00* (2006.01)

(52) U.S. Cl. ..... 162/272; 162/199; 34/111; 34/122

(58) Field of Classification Search ..... 162/199, 162/272; 34/111–122
See application file for complete search history.

(56) References Cited

U.S. PATENT DOCUMENTS 5,347,728 A * 9/1994 Pinter et al. ..... 34/115

FOREIGN PATENT DOCUMENTS

| | | | |
|---|---|---|---|
| CN | 608257 | A5 | 12/1978 |
| DE | 19728824 | * | 1/1999 |
| DE | 19728824 | A1 | 1/1999 |
| EP | 0639667 | A1 | 2/1995 |
| FI | 3345/68 | | 8/1970 |
| WO | WO-81/02753 | A1 | 10/1981 |
| WO | WO-95/07387 | A1 | 3/1995 |
| WO | WO-99/64667 | A1 | 12/1999 |

OTHER PUBLICATIONS

PCT/ISA/210—International Search Report—May 17, 2006.

* cited by examiner

*Primary Examiner*—Mark Halpern
(74) *Attorney, Agent, or Firm*—Venable LLP; Eric J. Franklin

(57) ABSTRACT

A device for removing a liquid, dusty or solid substance from a moving fabric or web. A roll is placed transversely in relation to the moving fabric or web and arranged to rotate around a rotation axis. The roll includes an outer mantle through which a liquid or air flow can enter the inside of the roll. The rotating roll is placed inside a chamber. The chamber includes an opening in a direction of the rotating axis. The opening is arranged to expose at least a part of the outer mantle such that the moving fabric or web tangential to the chamber can be supported against the outer mantle. At least a spiral, screw or threaded structure is arranged inside the rotating roll at a distance from the outer mantle, and is arranged to rotate around a rotating axis and to transfer liquid or air that has entered the roll in the direction of the rotation axis.

13 Claims, 3 Drawing Sheets

DEVICE FOR REMOVING LIQUID FROM A MOVING FABRIC OR WEB

CROSS-REFERENCE TO RELATED APPLICATIONS

This application claims priority to Finnish patent application 20055092 filed 24 Feb. 2005 and is the national phase under 35 U.S.C. §371 of PCT/FI2006/050074 filed 21 Feb. 2006.

FIELD OF THE INVENTION

The invention relates to a device for removing a liquid, dusty or solid substance from a moving fabric or web.

BACKGROUND OF THE INVENTION

The conventional function of the wet end of a paper machine is based on, for example, the so-called Fourdrinier principle, by which an endless rotating wire is covered with pulp which consists of a liquid and the fibres required for paper manufacture and which is herein also called a web. Water is removed from the web at several different steps by means of devices placed under the wire and including, for example, foils and various suction boxes.

The foils are stationary blades which are placed underneath the wire and which have a suction effect. By the suction effect, the wire is pressed against the foil, wherein due to the friction, the speed of the wire must be limited, or the suction effect of the foil must be reduced. Consequently, to have a sufficient dewatering capacity, several foils must be placed under the wire, and the friction causes wear of the wire. To increase the dewatering capacity, several foils may be placed in a box having an underpressure, wherein dewatering of the web takes place also between the foils. It is obvious that an increase in the suction effect will increase the friction and the wear of the foil. Liquid is also removed from the web by means of suction boxes in which the suction is stronger and circular perforations or openings are provided in the flat upper surface. Finally, liquid and moisture are removed from the web by means of a couch roll with a rotating mantle provided with perforations or openings and with a suction inside. The dewatering of the wire and the web is partly based on compression and partly on the effect of air sucked through the wire and the web. The couch roll must be placed in such a way that the couch roll does not cause harmful sprinkling of liquid downstream. Consequently, for dewatering, several different techniques are used in parallel, examples being mentioned in the document WO 81/02753.

An increase in the speed of the wire will result in an increase in the length of that part of the paper machine where said dewatering of the web takes place. On the other hand, an increase in the suction effect to increase the dewatering capacity will cause an increase in the friction and wear of the wire. Increasing the number of foils or suction boxes, in turn, will increase the length of the machine and the friction caused. Furthermore, the selection of the devices used for dewatering should not have a negative effect on the pulp, for example due to shaking, because it will affect the final quality of the paper web.

A suction box is presented in EP 0 639 667 A1. Said suction box comprises a roll rotating with the wire and having a mantle that is, for example, meshed. The roll is placed in the box under a negative pressure. Air flows through the wire and the mantle of the roll. A device for producing suction in the suction box is presented in WO 99/64667 A1.

The production of the suction requires a separate device to be placed somewhere and to be maintained, which causes costs.

WO 95/07387 A1 discloses a device used for controlling a felt and a web supported on it, applying a rotating roll whose perforated mantle is permeable to air. Blades are fixed to the inner surface of the roll to produce and control an air flow. The function of the device is to produce a suction to keep the felt attached to the mantle and to prevent the felt from shrinking. Some embodiments of said document show that the suction cannot be produced by means of the blades, but the device must be connected to a separate device for producing the actual suction and not just for making the function of the roll more efficient. It is also very difficult and expensive to manufacture the device and difficult to clean it, because the blades must be fixed to the inner surface of the mantle. Other rolls are also known which are provided with a perforated mantle and equipped with a suction by means of a separate device. U.S. Pat. No. 5,347,728 discloses a device in which the blades are also placed on the inner surface of the mantle, or fixed on the central shaft of the roll. The function of said blades is to prevent a turbulent or rotational air flow affecting the suction.

SUMMARY OF THE INVENTION

It is the aim of the present invention to eliminate problems related to known suction boxes equipped with a roll, as well as the suction devices connected to them. First of all, the device of the invention provides efficient removal of liquid from the inside of the chamber used as a suction box. As the same device is also used for producing a sufficient suction effect, the web can be efficiently dewatered so that it will be unnecessary to use separate suction devices. The suction effect can be made stronger by connecting the device to a separate suction device, if one is available.

The invention includes a device, a method for removing liquid from a wire moving in a paper machine and from a web placed on the same, and use of the device according to the invention for cleaning a moving wire, felt or another fabric.

The device according to the invention can be used to support a moving wire so as to reduce friction compared with, for example, foils. The use of separate suction devices is not necessary, when a sufficient suction effect is produced by the device. Furthermore, a high dewatering capacity is achieved with the device, so that it can also be applied for wires with a high speed, wherein the increase in the length of the dewatering part of the paper machine can be limited. In particular, the device can be used to replace suction boxes of prior art which are used for dewatering in that section of the paper machine where wires of different types are used.

The device according to the invention is suitable for the removal of a liquid as well as solids, for example dust, from a wire, a felt or various other fabrics which are used, for example, in a paper machine. The device is also applicable for the removal of dust developed, for example, during the manufacturing process of various fabrics or the like, or for the removal of liquid, dust and solids accumulated during their cleaning. Consequently, the device can be used as a so-called cleaning device or a dewatering device to remove liquid or solid matter from a moving pulp, web or fabric, examples to be mentioned including a wire and a felt. The fabric, the wire, the felt, or the like must have a sufficient permeability to air or a liquid.

One embodiment of the device combines the properties utilizing both the suction effective through the wire and the web, and the suction effect produced at the edge of an opening of the device, which corresponds to the function of a foil. A rotating roll is placed in said opening, whose back edge is provided with a foil that both seals the space between the chamber and the rotating roll and removes water from the web and the wire.

In one embodiment of the device, an intensified dewatering capacity and/or suction effect is produced by means of a structure inside the rotating roll which, in one particular embodiment of the invention, is for example a spiral, threaded or screw-like structure made of blades. Said structure is connected to or made onto the outer surface of a separate inner mantle inside the outer mantle of the roll, wherein it is significantly easier to manufacture. Moreover, there are more possibilities for constructing the outer mantle of the roll, because the spiral is not connected to the inner surface of the outer mantle. Therefore, also various fabrics can be used as the outer mantle.

BRIEF DESCRIPTION OF THE DRAWINGS

In the following, the invention will be described in more detail with reference to the appended drawings, in which.

DETAILED DESCRIPTION OF EMBODIMENTS OF THE INVENTION

Figure 1:
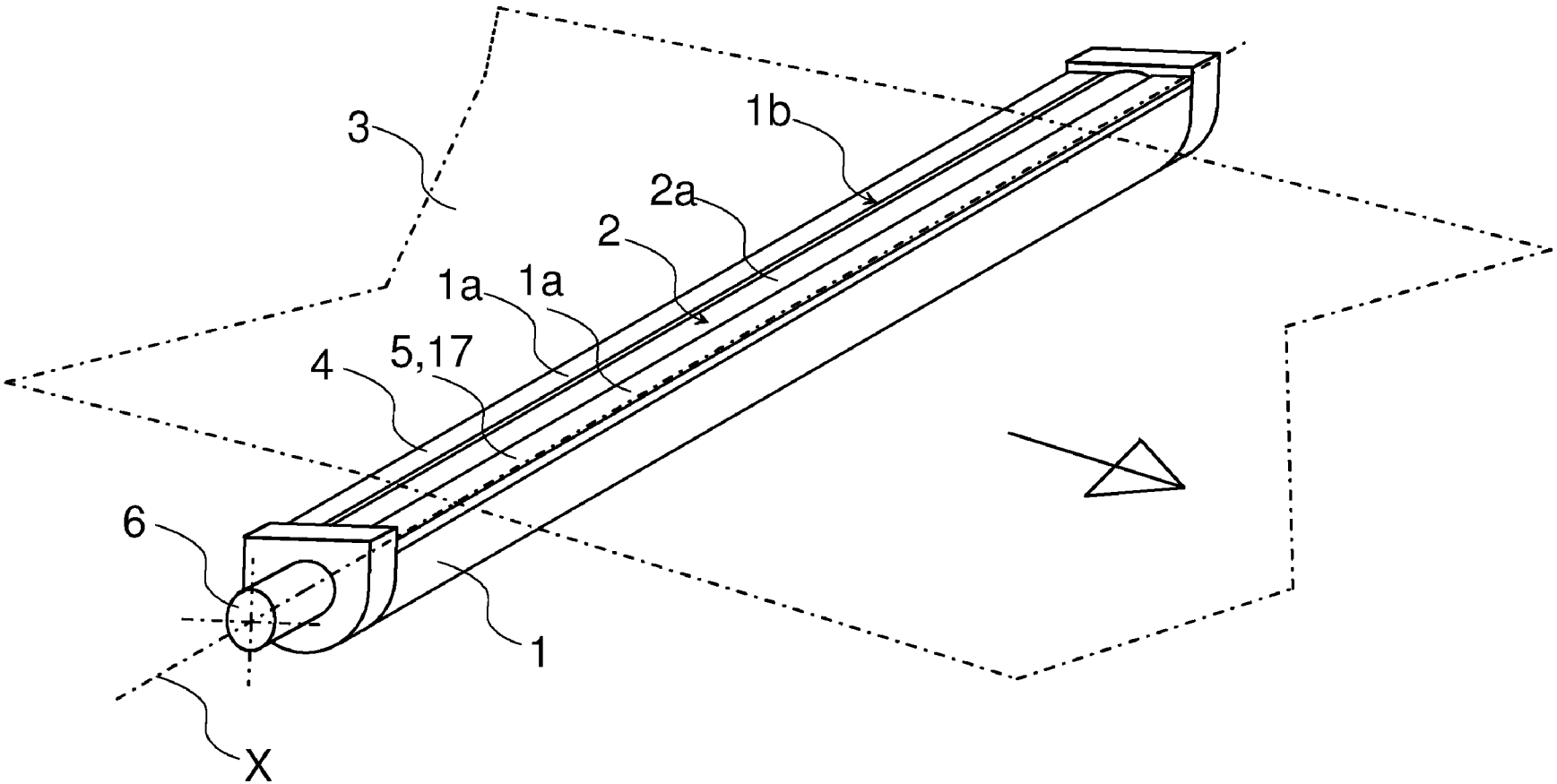
FIG. 1 illustrates the principle of the whole device and its placement by a web and a wire.

As shown in FIG. 1, the device comprises a box-like and sealed chamber used as a basin, in which a rotating roll 2 has been placed. The upper surface 1*a* of the box, on and against which a fabric 3 is placed, is substantially flat and typically horizontal. The chamber 1 is elongated and extends preferably underneath the fabric 3 substantially across its whole length. The chamber 1 is placed in a direction transverse to the running direction of the fabric 3, primarily in a perpendicular direction, as does an opening 1*b* in the upper surface 1*a* of the chamber 1, which opening is uniform and continuous and extends across the whole width of the fabric 3 in the embodiment of FIG. 1. A roll 2 is placed inside the chamber 1 and is allowed to rotate with the fabric 3. The opening 1*b* exposes at least part of the outer mantle 2*a* of the roll 2 in such a way that the moving fabric 3 or web that is tangential to the chamber 1 can be supported to the outer mantle 2*a*. Preferably, the roll 2 extends slightly higher than the upper surface 1*a* and causes a gently sloping ridge in the fabric 3, when the wire is placed or aspirated against the outer mantle 2*a*. This part of the outer mantle 2*a* covers a sector-like part limited by seals 4 and 5 at the front and back edges of the opening 1*b*. The exposed sector-like part encompasses about a quarter or less of the outer mantle 2*a* shown in FIG. 1. In the presented embodiment, said seals 4, 5 simultaneously constitute the upper surface 1*a* and cover the gap left between the outer mantle 2*a* and the upper surface 1*a*. The latter seal 5 simultaneously separates the wire 3 from the roll 2. The seals 4 and 5 are connected to the upper part of the chamber 1 or to supporting structures above the chamber 1.

Figure 4:
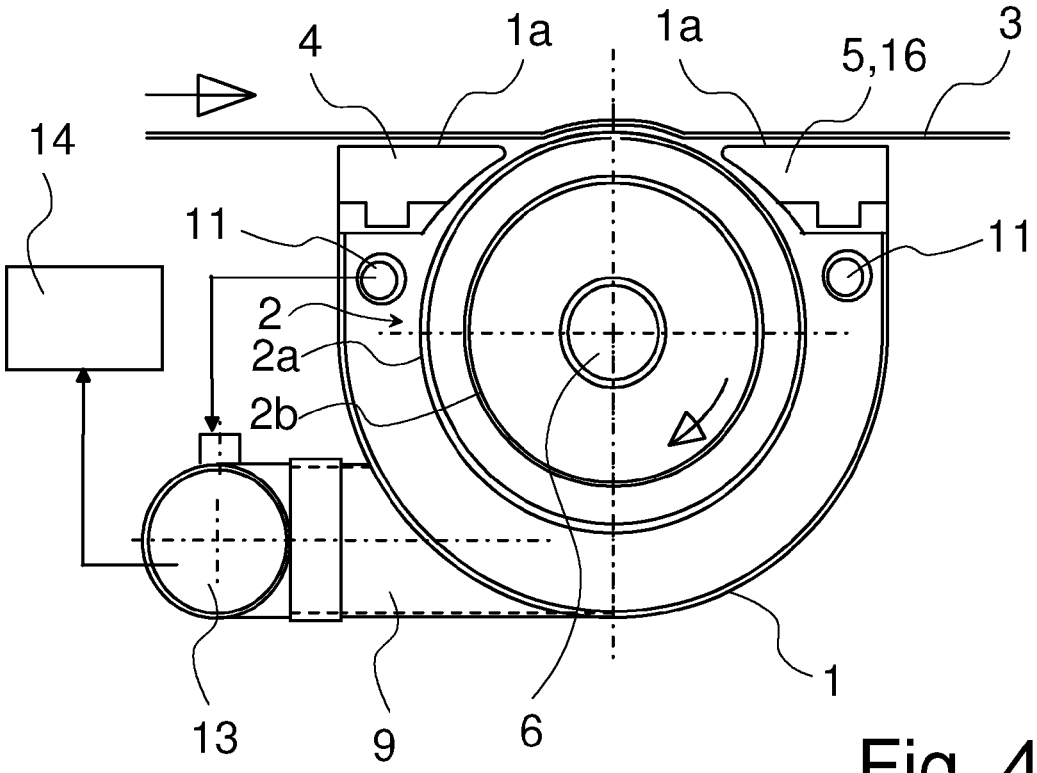
FIG. 4 shows the device of FIG. 1 in a partial cross-sectional view seen from the end.

In one embodiment of the invention, shown in FIG. 4, a foil 16 is provided at least at the rear edge of the opening 1*b*, to be used also as a sealing and simultaneously to produce a suction underneath the fabric 3 in a way known as such, when the fabric 3 runs on the foil 16. The fabric 3 runs along the flat upper surface 1*a* of the foil 16, which is simultaneously the upper surface 1*a* of the chamber 1, and the suction effective on the fabric 3 aspirates, for example, a liquid from the fabric 3 into the gap between the foil 16 and the outer surface 2*a* and further into the chamber 1.

The roll 2 is arranged to rotate around a rotation axis X, and the rotation axis is parallel with the longitudinal axis of the roll 2 and also with the opening 2*a*. The width of the opening 2*a* is a fraction of the length of the roll 2 and the opening 2*a*. The longitudinal axis is parallel with the chamber 1 and transverse to the direction of movement of the fabric 3. The moving fabric 3 rotates the roll 2 with a friction that is effective on the outer mantle 2*a* so that the roll 2 tends to rotate at a speed matching with the speed of the fabric 3.

The roll 2 comprises the structure of a shaft 6, for example a solid shaft mounted with bearings at each end in an appropriate way. In the presented embodiment, the ends 6*a* of the shaft 6 protrude from both ends 1*b* of the chamber 1, wherein the bearings can be easily arranged outside the chamber 1. The gap between the end 1*b* of the chamber 1 and the shaft 6 is sealed with appropriate sealings 7 so that no liquid leaks through the gap, or particularly so that the suction effective in the chamber 1 would not cause a suction effect through said gap. The other structures of the chamber 1 must also be sealed for the same reason.

Figure 5:
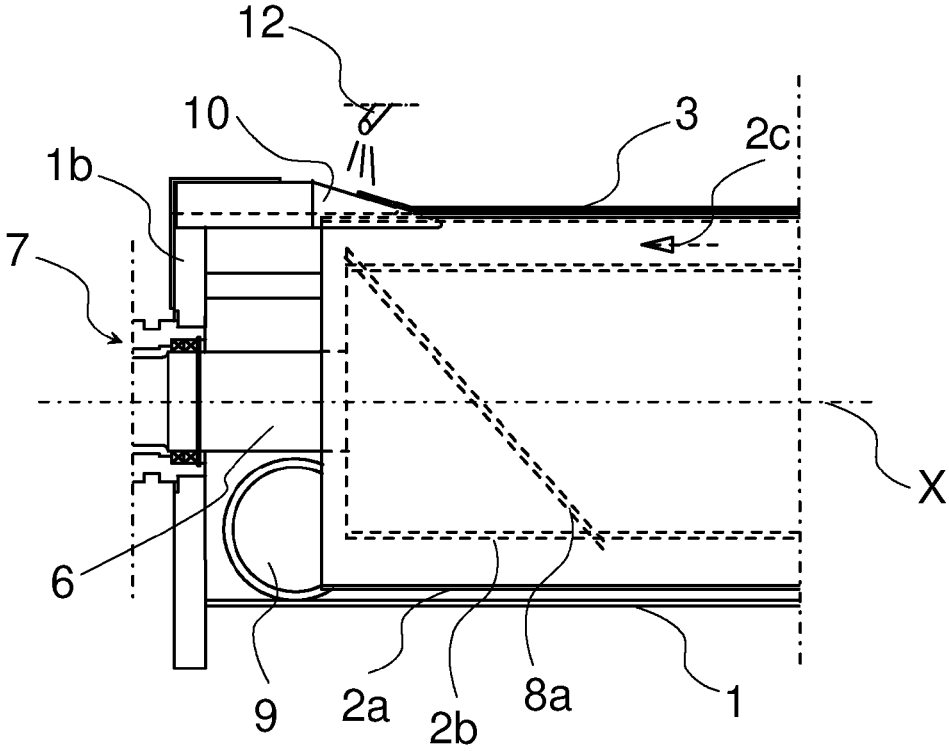
FIG. 5 shows the device of FIG. 1 in a partial cross-sectional view seen from the side.

If desired, at least one end 6*a* of the shaft 6 may be connected to a separate rotating device 15, typically an electric motor, to rotate the roll 2 via the shaft 6. By means of the rotating device 15, the roll 2 can be accelerated to the speed of the fabric 3, after which the rotation of the roll 2 can be provided by the friction between the fabric 3 and the outer mantle 2*a*. The rotating device 15 can also be driven continuously to ensure that the roll 2 rotates at the speed of the fabric 3, wherein the rotating device comprises an appropriate speed control and a sensor system for monitoring the speed of the fabric 3. In the presented embodiment, the rotating device 15 is placed outside the chamber 1, and the shaft end 6*a* coupled to the rotating device 15 extends through the end 1*b* of the chamber 1 in a sealed manner as shown in FIG. 5.

Figure 2:
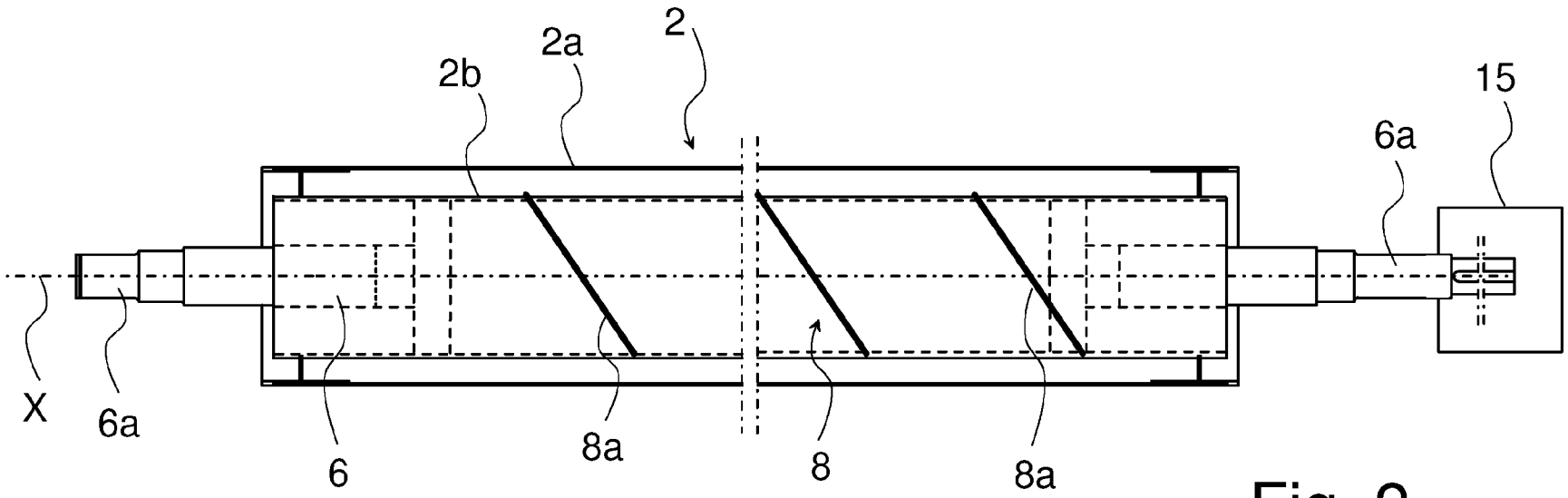
FIG. 2 shows a partial cross-sectional view of a roll applied in the device according to FIG. 1.

As shown in FIG. 2, the roll 2 comprises an outer mantle whose cross-section is circular in a plane perpendicular to its rotation axis X. The outer mantle 2*a* can be made, for example, as a wire-cloth which is permeable to liquid and air. In a way known as such, the outer mantle 2*a* may be perforated or equipped with holes or openings, through which the suction is effective on the moving fabric 3. Through the outer mantle 2*a*, the liquid or air flow can enter the inside of the roll 2. The air flow effected by the suction and passing through the fabric and the web 3 carries liquid, dust and possibly other solids that can penetrate the fabric 3 and the outer mantle 2*a*.

In this embodiment, the inner surface of the outer mantle 2*a* of the roll 2 is not provided with blades or vanes to influence the suction effect or the movement of the liquid removed from the fabric 3 inside the roll 2. A separate inner mantle 2*b* is placed inside the outer mantle 2*a* of the roll 2, at a distance from the outer mantle 2*a* and centrally on the rotating axis X. The cross-section of the inner mantle 2*b* is circular in a plane perpendicular to the rotation axis X of the roll 2.

The inner mantle 2*b* is made of, for example, a bent sheet material either fixed around the structure of the shaft 6 in a suitable way or fixed between two separate shaft ends 6*a*. There are several alternatives for constructing the structure of the shaft 6, the outer mantle 2*a* and the inner mantle 2*b*. The outer mantle 2*a* and the inner mantle 2*b* can be formed, for example, by means of two concentric tubes within each other, fixed to each other by necks. In the embodiment shown in the drawings, the outer mantle 2*a* is connected to the shaft 6 by means of the inner mantle 2*b*, and the shaft 6, in turn, is mounted on bearings by means of shaft ends 6*a* for rotation. For the construction of the roll 2, it is also possible to apply rolls known as such and to provide them with an outer mantle 2*a* and a spiral, screw or threaded structure 8. The inner mantle 2*b* may also be the outer surface of the shaft 6, and the spiral, screw or threaded structure 8 may be fixed directly to the shaft 6.

In one embodiment of the roll 2, the shaft 6 and the outer mantle 2*a* are independently movable, wherein the outer mantle 2*a* is mounted on bearings either on the shaft 6, for example the shaft ends 6*a*, or another supporting structure, for example the end 1*b* of the chamber 1, and it is allowed to rotate irrespective of the shaft 6. The shaft 6 and the structures connected to it rotate or stand still irrespective of the outer mantle 2*a*. The above-presented embodiment, in which the outer mantle 2*a* and the shaft 6 are independently movable, makes versatile uses of the device possible. A separate rotating device 15 is used for the shaft 6 and placed for example at one end of the chamber 1, and if necessary, a separate rotating device is used for the outer mantle 2*a* and placed at the other end of the chamber 1.

In said embodiment, the outer mantle 2*a* may rotate without the shaft 6, so that its mass is also smaller and its acceleration and deceleration are easier. It is not necessary to rotate the shaft 6 when the suction effect is only produced by means of a separate suction device 14 connected to the chamber 1. Also, rotation is not necessary when there is no need to intensify either the dewatering and/or the suction effect by means of a particular spiral, screw or threaded structure 8. The shaft 6 is coupled to the rotating device 15, by means of which the pumping effect and/or the suction effect of the spiral, screw or threaded structure 8 can be started or maintained also when the speed of the outer mantle 2*a* is relatively low and smaller than the desired speed of the spiral, screw or threaded structure 8. In this way, the pumping and/or suction effect can be maintained even when the outer mantle 2*a* is not moving.

Figure 3:
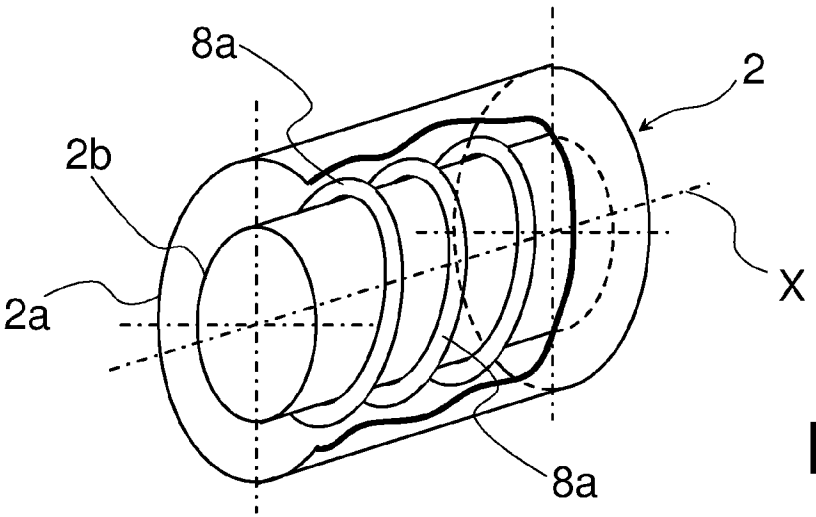
FIG. 3 shows a partial view of a spiral, screw or threaded structure applied in the roll of FIG. 2.

The spiral, screw or threaded structure 8 is arranged to rotate around the rotation axis X and to move the liquid or air transferred into the roll 2 and the chamber 1 in the direction of the rotation axis X. The aim is to intensify the removal of, for example, liquid from the chamber 1. In one alternative, the spiral, screw or threaded structure 8 is arranged to cause, when rotating, also a pressure difference between the inside of the roll 2 and the space outside the chamber 1. The pressure difference causes a liquid or air flow through the outer mantle 2*a* and simultaneously the fabric 3 or web into the chamber 1. The roll 2 accommodates, for example, blades 8*a* according to the embodiment of FIG. 3, which form the spiral, screw or threaded structure 8 encircling the inner mantle 2*b*. The spiral, screw or threaded structure 8 is placed in such a way that by the rotary movement, the blades 8*a* guide the liquid and/or the air flow either to one end 1*b* or both ends of the chamber 1. The spiral, screw or threaded structure 8 is thus either unidirectional or bidirectional, and the direction of rotation of the spiral, screw or threaded structure 8 is reversed in the middle of the inner mantle 2*b*. The spiral, screw or threaded structure 8 encircles the inner mantle 2*b* counter-clockwise, seen from the center of the inner mantle 2*b* towards the ends 1*b*. The spiral, screw or threaded structure 8 may consist of one or several separate blades 8*a* which are close to each other and/or one after each other at a distance from each other. The spiral, screw or threaded structure 8 extends to a distance from the inner surface of the outer mantle 2*a*, and a ring-like channel 2*c* is formed therebetween.

The spiral, screw or threaded structure 8 may also be constructed in such a way that a corresponding threaded grooving, a spiral groove or a threaded groove is formed on the surface of the inner mantle 2*b*, for example by means of one or more separate grooves. In one alternative, by a grooving that is sufficiently wide and has a suitable depth, a neck is formed between the grooves to correspond to a blade 8*a*.

The pitch of the spiral, screw or threaded structure 8 is constant over the whole length of the inner mantle 2*b*, or the pitch changes, for example growing towards the end 1*b*. The spiral, screw or threaded structure 8 may also be arranged to be adjustable in such a way that the position of the blades 8*a* is adjustable; in other words, their angle can be changed to be either more obtuse or sharper, wherein the pitch of the spiral, screw or threaded structure 8 is changed. In the embodiment shown in the drawings, the pitch is constant, the spiral, screw or threaded structure 8 is unidirectional, and the position of the blade 8*a* is fixed.

The chamber 1, at least its lower part, is substantially circular, and at least one duct 9 is connected to its one end 1*b* or both ends, and if necessary, also in the middle, to be coupled to a separate suction system 14. If necessary, the chamber 1 is connected to the separate suction system 14 to provide an increased suction effect for aspirating air through the fabric 3 to the inside of the roll 2. The suction is effective between the chamber 1 and the roll 2 and further through the roll 2 on the fabric 3.

In the embodiment of FIG. 4, the duct 9 is placed in the bottom part of the chamber 1 in such a way that the flow exits the chamber in a tangential direction in relation to the rotating roll 2. This embodiment also applies a collection tube 13 extending in the direction of the rotating axis X and being coupled to the suction system 14. The ducts 11 in the chamber 1, which are used for the removal of liquid from the inner walls of the chamber 1, are also connected to the collection tube 13. The ducts 11 are used for controlling the level of the fluid accumulated in the chamber 1 in relation to the roll 2. The spiral, screw or threaded structure 8 is placed at least partly underneath the fluid level. In the presented embodiment, the ducts 11 are slightly higher than the rotating axis X, at approximately ⅓ of the radius of the roll 2. For example cut-off valves may be coupled to the ducts 9, 11 and the collection tube 13.

FIG. 5 shows the end part of the roll 2 and the chamber 1 in more detail. A slanted sealing surface 10 is provided at the end part of the chamber 1, on its upper surface 1*a*, placed partly underneath the fabric 3. The sealing surface 10 is placed onto the roll 2, and simultaneously it covers the opening 1*b*. The sealing surface 10 is fixed to the upper part of the chamber 1, the supporting structures above the chamber 1, or the sealings 4 and 5. The shape of the lower side of the sealing surface follows the shape of the roll 2 at the opening 1*b*. In one embodiment, the sealing surface 10 can be placed in the direction of the rotation axis X. In another alternative, the slanted sealing surface 10 is implemented by means of a tilted plate placed above the chamber 1, the lower edge of the plate being placed against the roll 2. The lower edge has a concave shape matching with the shape of the roll 2.

One or more spray jets 12 are also placed at the edge of the sealing surface 10 and the fabric 3 to spray a liquid to a location where the sealing surface 10 and the fabric 3 touch each other. By means of the sprayed liquid, the fabric 3 moves more easily along the sealing surface 10, and the same liquid also seals the location to prevent the passage of an air flow through said location.

The invention is not limited solely to the above-presented embodiments which are used as examples of the more detailed implementation of the invention, but the invention may vary within the scope of the appended claims.

The invention claimed is:

1. A device for removing a liquid, dusty or solid substance from a moving fabric or web, the device comprising:

a roll placed transversely in relation to the moving fabric or web and arranged to rotate around a rotation axis, and comprising an outer mantle configured to permit a flow of a liquid or air to enter the inside of the roll;

a chamber, inside which said rotating roll is placed, and which comprises an opening in the direction of said rotating axis, the opening being arranged to expose at least a part of the outer mantle in such a way that the moving fabric or web, tangential to the chamber, can be supported against the outer mantle; and at least one spiral, screw or threaded structure which is arranged inside said rotating roll, at a distance from its outer mantle, and is arranged to rotate around a rotating axis and to transfer a liquid or air that has entered the roll in the direction of said rotation axis.

2. The device according to claim 1, wherein the spiral, screw or threaded structure is configured to cause a pressure difference between the inside of the roll and the space outside the chamber, wherein said pressure difference simultaneously causes a liquid or air flow through the outer mantle and simultaneously the fabric or web.

3. The device according to claim 1, wherein the spiral, screw or threaded structure is placed on an inner mantle, which is placed around said rotating axis, and that the spiral, screw or threaded structure extends from the inner mantle towards the outer mantle.

4. The device according to claim 1, wherein a convolution of the spiral, screw or threaded structure has a constant pitch or a changing pitch.

5. The device according to claim 1, wherein the spiral, screw or threaded structure comprises a blade or several blades placed in parallel or one after each other.

6. The device according to claim 1, wherein at least one edge of said opening is provided with a foil configured to support the moving fabric or web and which is arranged to remove liquid from the fabric or web and to guide the liquid through a gap between the roll and the foil to the inside of the chamber.

7. The device according to claim 1, wherein the chamber comprises an upper surface, in which said opening is placed and which is arranged to be substantially flat and to support the fabric or web moving in a substantially straight position.

8. The device according to claim 1, wherein the spiral, screw or threaded structure and the outer mantle are rotatable independently of each other around said axis line, the device further comprising:

a rotating device for at least the spiral, screw or threaded structure.

9. The device according to claim 1, wherein the spiral, screw or threaded structure and the outer mantle are connected to the roll in such a way that they always rotate together, the device further comprising:

a rotating device for the roll.

10. The device according to claim 1, wherein the roll comprises a shaft which is placed on said rotation axis and around which the spiral, screw or threaded structure and the outer mantle are placed, and which comprises two shaft ends, at least one of them extending through the end of the chamber in a sealed manner, wherein said shaft ends are fitted with bearings for rotation.

11. The device according to claim 1, wherein the chamber comprises one or more ducts configured to remove the liquid or air flow from the chamber and configured to be connected to a separate suction device for the purpose of intensifying the air flow through the outer mantle and simultaneously through the fabric or web.

12. The device according to claim 1, wherein the chamber comprises one or more ducts, through which the liquid can be removed from the chamber to keep the fluid level in the chamber at a desired level.

13. The device according to claim 1, wherein said device is placed in a part of a paper machine where said fabric is a moving wire and where said device is arranged to remove liquid from a web placed on the wire.

* * * * *